US010293912B2

(12) United States Patent
Etherington-Smith

(10) Patent No.: US 10,293,912 B2
(45) Date of Patent: May 21, 2019

(54) MARINE PROPULSION UNIT AND A VALVE FOR A MARINE PROPULSION UNIT

(71) Applicant: E.P. Barrus Limited, Oxfordshire (GB)

(72) Inventor: David Phillip Etherington-Smith, Oxfordshire (GB)

(73) Assignee: E.P. Barrus Limited, Oxfordshire (GB)

( * ) Notice: Subject to any disclaimer, the term of this patent is extended or adjusted under 35 U.S.C. 154(b) by 41 days.

(21) Appl. No.: 15/029,756

(22) PCT Filed: Oct. 17, 2014

(86) PCT No.: PCT/GB2014/053119
§ 371 (c)(1),
(2) Date: Apr. 15, 2016

(87) PCT Pub. No.: WO2015/056026
PCT Pub. Date: Apr. 23, 2015

(65) Prior Publication Data

US 2016/0251069 A1 Sep. 1, 2016

(30) Foreign Application Priority Data

Oct. 17, 2013 (GB) ..... 1318387.6

(51) Int. Cl.
*B63H 21/38* (2006.01)
*F02B 61/04* (2006.01)
(Continued)

(52) U.S. Cl.
CPC ..... *B63H 21/38* (2013.01); *B63H 21/14* (2013.01); *F02B 61/045* (2013.01); *F02N 19/00* (2013.01);
(Continued)

(58) Field of Classification Search
CPC ..... B63H 21/38; B63H 21/14; B63H 20/001; F02N 19/004; F02N 19/00; F02B 61/045;
(Continued)

(56) References Cited

U.S. PATENT DOCUMENTS 3,418,992 A 12/1968 Anderson et al.
4,321,904 A * 3/1982 Bristol ..... F02B 25/20 123/311
(Continued)

FOREIGN PATENT DOCUMENTS

GB 922788 A 8/1959
GB 119616 3/1978
(Continued)

OTHER PUBLICATIONS

International Search Report and Written Opinion for corresponding International Application No. PCT/GB2014/053119 dated Feb. 2, 2015.
(Continued)

*Primary Examiner* — Joseph J Dallo
*Assistant Examiner* — Kurt Philip Liethen
(74) *Attorney, Agent, or Firm* — Renner Otto Boisselle & Sklar, LLP

(57) ABSTRACT

A valve for a marine propulsion unit comprises a valve body (11) having an end face (13) and a wall (14) extending from the end face. An aperture (15) is defined in the end face. A valve stem (12) is moveable within and with respect to the valve body, such that, in the closed state of the valve, the valve stem closes the aperture. A maximum width ($d_1$) of the valve stem is greater than the width ($d_2$) of the aperture in the end face of the valve—so that, if the valve stem should fracture, the detached portion(s) of the valve stem will be retained in the valve body. The valve may for example be used as a cylinder drain valve in a marine propulsion unit.

10 Claims, 4 Drawing Sheets

(51) Int. Cl.

| | |
|---|---|
| ***F02N 19/00*** | (2010.01) |
| ***B63H 21/14*** | (2006.01) |
| *F02B 75/02* | (2006.01) |
| *F01L 1/32* | (2006.01) |
| *F01L 3/00* | (2006.01) |
| *B63H 20/00* | (2006.01) |

(52) U.S. Cl.
CPC ..... *F02N 19/004* (2013.01); *B63H 20/001* (2013.01); *F01L 1/32* (2013.01); *F01L 2003/258* (2013.01); *F02B 2075/025* (2013.01)

(58) Field of Classification Search
CPC .. F02B 2075/025; F01L 2003/258; F01L 1/32
See application file for complete search history.

(56) References Cited

U.S. PATENT DOCUMENTS 5,671,906 A * 9/1997 Rosen ..... B08B 9/00 114/183 R
5,701,859 A 12/1997 Edlund
6,286,467 B1 * 9/2001 Ancheta ..... F02B 69/06 123/21
6,311,653 B1 * 11/2001 Hamamoto ..... F01L 9/04 123/306
6,676,466 B1 * 1/2004 Glen ..... F02B 61/045 440/88 R
2014/0332089 A1 * 11/2014 Lakshmanan ..... B24B 1/00 137/15.07

FOREIGN PATENT DOCUMENTS

GB 2 349 420 A 11/2000
WO WO 2009/007493 A1 1/2009

OTHER PUBLICATIONS

British Search Report dated Nov. 18, 2013 for corresponding British Application No. GB1318387.6.

* cited by examiner

MARINE PROPULSION UNIT AND A VALVE FOR A MARINE PROPULSION UNIT

The present invention relates to a valve for a marine propulsion unit, in particular to a valve that can be opened, for example by a user, to drain water from a cylinder of a marine propulsion unit. It also relates to a marine propulsion unit, for example, such as an outboard motor, having such a valve.

A propulsion unit, such as an internal combustion engine, for a land vehicle is normally not designed in any way for contact with, or immersion in, a body of water. Should such immersion occur as a result of an accident, the engine will stop, become flooded with water, and will need attention before it can be restarted.

It is not unknown for boats fitted with small motors, such as outboard motors, to capsize. This can happen, for example, on a rescue mission, if the boat is swamped by breakers when the boat is working close in shore. Alternatively, when a rescue vessel is approaching another vessel, it is possible for waves to be re-directed by the vessel that requires rescue and these can swamp the rescue vessel. Furthermore, when a rescue vessel is launched into heavy seas it is possible for the boat to be capsized upon launch. When the vessel capsizes the motor will be submerged, and water will flood into the engine.

Even in the case of a vessel provided with a self-righting capability, the engine is generally flooded with water by the time the vessel has righted itself. Water will inevitably enter the engine, even though mercury gravity switches are provided to switch off the engine once a predetermined angle of roll is reached.

There have been attempts to provide water-proof internal combustion engines, for vehicles required to have full on-land/in-water capability such as tanks. A fully waterproofed engine is, however, expensive. Furthermore, maintenance of such engines is complicated, since great care must be taken during maintenance if the waterproofing is to be maintained.

GB 2 349 420 describes a marine propulsion unit having an aperture that is openable independent of the position of a piston within its cylinder. This process is illustrated schematically in FIG. 2, which is taken from GB 2349420. A poppet valve 6 is provided in the cylinder head 5; the valve 6 is shown in larger scale in FIG. 1. The valve 6 is mounted in the cylinder head 5, and has a valve stem 7 that can be moved away from its seating 8 in order to open the valve. This allows water to be drained from the propulsion unit, to shorten the time required to restart the propulsion unit after it has been immersed in water.

To assist in understanding of the invention, a brief review of the content of GB 2 349 420 is provided.

FIG. 3, which is also taken from GB 2 349 420, is a schematic illustration of a marine propulsion unit, specifically a two-stroke internal combustion engine. Only one cylinder 1 is shown in FIG. 3 for clarity and ease of explanation, although the propulsion unit will in general have two or more cylinders.

A combustion chamber 31 is disposed at a first end of the cylinder 1, and a crank-case 24 is disposed at a second end of the cylinder 1. The engine is a crank-case scavenged engine, and a transfer passage 27 connects the crank-case 24 to the combustion chamber 31. The propulsion unit shown in FIG. 3 is arranged with the cylinder being generally horizontal, and with the transfer passage 27 being disposed underneath the cylinder 1. The present invention, however, is not limited to an engine having this particular orientation.

A piston 2 is disposed within the cylinder, and can move reciprocably within the cylinder. A crank-shaft 25 is disposed within the crank-case 24, and the piston 2 is connected to the crank-shaft 25 by a connecting rod 26, so that reciprocating motion of the piston 2 is converted into rotary motion of the crank-shaft 25. In use, fuel and air are introduced into the crank-case from a carburettor 29 by inlet means (not shown) such as a conventional reed valve. When the end of the transfer port nearer the combustion chamber is open, the air/fuel mixture passes from the crank-case 24 through the transfer passage 27 into the combustion chamber 31. When the piston 2 moves towards the combustion chamber (to the left in FIG. 3) it will close the entry to the transfer passage, and subsequent movement of the piston towards the combustion chamber will compress the fuel-air mixture. The mixture is then ignited by one or more spark plugs 3 provided in the combustion chamber (only one spark plug is shown in FIG. 3 for clarity, but more than one spark plug could be provided), and the resultant combustion of the fuel-air mixture drives the piston 2 away from the combustion chamber 31. An exhaust port E allows the combustion products to exhaust from the cylinder when it is uncovered by the piston.

The propulsion unit of FIG. 3 is provided with a purging system for draining water from the propulsion unit. The purging system shown in FIG. 3 essentially consists of two valves provided in the propulsion unit. A first valve 32 is provided in the combustion chamber and a second valve 28 is provided in the transfer passage. These valves are additional to the exhaust port E, and they are selectively and independently openable regardless of the position of the piston 2 in the cylinder 1. The valves are shown in their open states in FIG. 3, but in normal operation of the propulsion unit both ports will be closed.

If the marine propulsion unit should be immersed in water, for example if the vessel in which the propulsion unit is mounted sinks or capsizes, once the vessel has been recovered/righted it will be necessary to drain the propulsion unit of water before the propulsion unit can be re-started. If the unit has stopped with the piston 2 blocking the exhaust port E of the cylinder it will not be possible for the water to leave the cylinder, so that the piston 2 is hydraulically locked and cannot move within the cylinder 1. In a multi-cylinder propulsion unit it is possible that the unit will stop with the crankshaft in a position such that the exhaust port in one cylinder is uncovered. However, if just one cylinder in the propulsion unit is hydraulically locked this will lock the entire unit and will prevent it from being re-started.

The first step in the purging process of GB 2 349 420 is to open the second valve 28 so that the interior of the propulsion unit is vented to atmosphere. Water can then drain out of the unit, in this embodiment through the transfer passage 27 and the second port 28. Subsequent opening of the first valve 32 enables release of hydraulic pressure above the piston (that is, from the combustion chamber 31). It is then possible to rotate the crank-shaft 25 and so reciprocate the piston 2 within the cylinder 1, and such movement of the piston 2 will cause water within the propulsion unit to be expelled through the second valve 28. The crank-shaft can be rotated either manually or, if the propulsion unit is fitted with a starter motor, using the starter motor.

The second valve 28 is preferably provided at the most efficient drainage point of the propulsion unit, to facilitate draining water from within the propulsion unit. In the case of a horizontally arranged propulsion unit having the arrangement shown in FIG. 3, the transfer passage 27 is the lowest part of the propulsion unit and the second valve 28 has therefore been positioned in the transfer passage. If, however, the propulsion unit is oriented such that the transfer passage 27 is not the lowest part of the engine, positioning the second valve in the transfer passage will not provide the most efficient drainage. In this case, the second valve 28 should be re-positioned to a more efficient drainage point than the transfer passage.

Simply draining the water from the interior of the cylinder 1 is not, however, sufficient to enable the engine to be restarted. This is because water will have become lodged in the contacts of the spark plug when water entered the cylinder, and this water will prevent the spark plug from igniting the fuel-air mixture. Accordingly, GB 2 349 420 proposes that water trapped within the contacts (9*a*,9*b* in FIG. 2) of the spark plug 3 is removed by continuing to reciprocate the piston 2 (as a result of continued rotation of the crank-shaft 25 once water has been drained from the engine. This continued movement of the piston 2 will cause gases within the top of the cylinder to flow over the spark plug as indicated in FIG. 2, thereby drying the spark plug.

The flow pattern of gas in the top of the cylinder is determined by the combined shape of the combustion chamber and the piston 2. During the rise of the piston in the cylinder, this flow of gas is arranged to be directed across the spark plug before it leaves the cylinder through the open valve (6 in FIG. 2). The rise of the piston creates a high velocity stream of gas, and the result of this high velocity stream of gas crossing the spark plug 3 is to remove water lodged in the contacts of the spark plug thereby enabling the spark plug to function normally. Once the water has been removed from the contacts of the spark plug, the valves 32 and 28 may be shut and the engine restarted.

A further consideration is that when an engine is flooded, water will enter all parts of the engine and in particular tends to lodge in the spark plugs. As well as draining water from the engine it is also necessary dry the spark plugs before the engine can be restarted. This can be done by, when the vessel is righted, removing the spark plugs and either drying them or replacing the wet spark plugs with new spark plugs—but this is very difficult to do in a small boat in heavy seas.

GB 2349420 therefore further describes that, once all water has been expelled from the propulsion unit, continued movement of the piston will cause the gas within the propulsion unit to flow over the spark plug. This flow of gas over the spark plug will remove any water that is trapped in the points of the spark plug, and so dry the spark plug in situ. Once the spark plug has been dried sufficiently to enable the propulsion unit to be restarted, the aperture is closed and the propulsion unit can then be restarted. This avoids the need to remove the spark plug in order to dry it. FIG. 2 shows a typical pattern of gas flow above the piston 2 for the case where the piston 2 is ascending in the cylinder 1 and the valve 6 is open. It will be seen that a significant part of the gas flow flows around the contacts 9*a*, 9*b* of the spark plug 3, and this will have the effect of removing the water trapped within the contacts of the spark plugs.

SUMMARY

A first aspect of the present invention provides a valve for a marine propulsion unit, the valve comprising: a valve body having an end face and a wall extending from the end face, an aperture being defined in the end face; and a valve stem moveable within and with respect to the valve body, wherein, in the closed state of the valve, the valve stem closes the aperture; and wherein a maximum width of the valve stem is greater than the width of the aperture in the end face of the valve.

In a preferred embodiment, the valve stem has a sealing portion located within the valve body in both an open state and a closed state of the valve, wherein, in the closed state of the valve, the sealing portion of the valve stem abuts against an inner surface of the end face of the valve body and thereby closes the aperture; and a maximum width of the valve stem is greater than the width of the aperture in the end face of the valve. The valve stem moves within the valve body (for example generally along the axis of the valve body), and the sealing portion of the valve stem is disposed within the valve body in both the open state and the closed state of the valve. Since the maximum width of the valve stem is greater than the width of the aperture in the end face of the valve, and since the valve stem is disposed within the valve body, if the valve stem should fracture, the detached portion(s) of the valve stem will be retained in the valve body, in contrast to the conventional valve of FIG. 2.

The sealing portion of the valve stem may comprise a sealing face provided on the valve stem, the sealing face abutting against the circumference of the aperture when the valve is in the closed state. The sealing face may be a frusto-conical sealing face.

When the valve is in the closed state, an end of the valve stem may be substantially flush with the outer surface of the end face of the valve body.

In an embodiment the valve stem does not project beyond the outer surface of the end face of the valve body when the valve is in the closed state.

The valve stem may comprise a portion extending beyond the sealing portion, the portion, when the valve is in the closed state, extending into the aperture in the end face.

Rotation of the valve stem relative to the valve body may cause the valve to change from the closed state to an open state.

A second aspect of the invention provides a marine propulsion unit comprising: a cylinder; a combustion chamber extending from a first end of the cylinder; a spark plug disposed within the combustion chamber; and a piston reciprocably moveable within the cylinder; wherein the unit further comprises a valve of the first aspect, the valve being selectively openable independent of the position of the piston within the cylinder, the valve being positioned such that, in its open state, movement of the piston causes gas within the propulsion unit to flow over the spark plug and subsequently to flow out of the propulsion unit through the first aperture.

The valve may be provided within the combustion chamber,

The end face of the valve body may be flush or substantially flush with an internal face of a wall of the combustion chamber.

The invention also provides a valve for a marine propulsion unit, the valve comprising: a valve body having an end face and a wall extending from the end face, an aperture being defined in the end face; and a valve stem moveable within and with respect to the valve body, wherein, in the closed state of the valve, the valve stem closes the aperture; and wherein, in the closed state of the valve, the valve stem does not project beyond the outer surface of the end face of the valve body.

Preferred embodiments of the present invention will now be described by way of illustrative example with reference to the accompanying figures, in which:

FIG. 4 is a schematic section view of a valve 10 according to an embodiment of the present invention in its closed state, and FIG. 5 shows the valve 10 in an open state.

Figure 2:
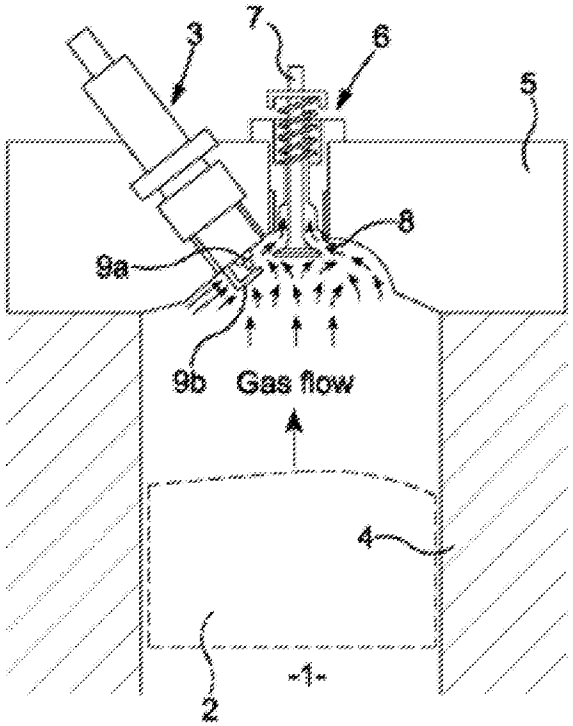
Fig. 2 (Prior Art)
FIG. 2 shows the prior art valve of FIG. 1 mounted in the cylinder head of a marine propulsion unit.
Figure 1:
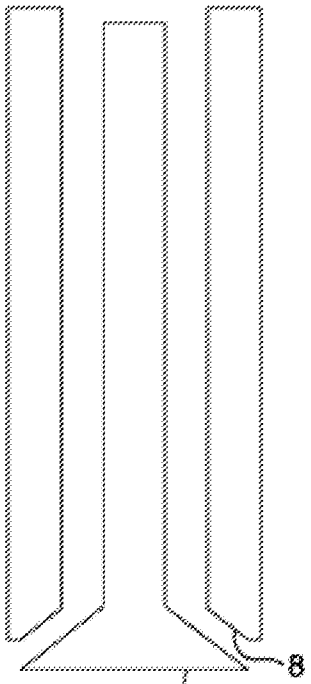
Fig. 1 (Prior Art)
FIG. 1 is a sectional view of a prior art valve.

The valve has a valve body 11 and a stem 12. The valve body has an end face 13 and a wall 14 extending from the end face. An aperture 15 is provided in the end face 13.

Figure 4:
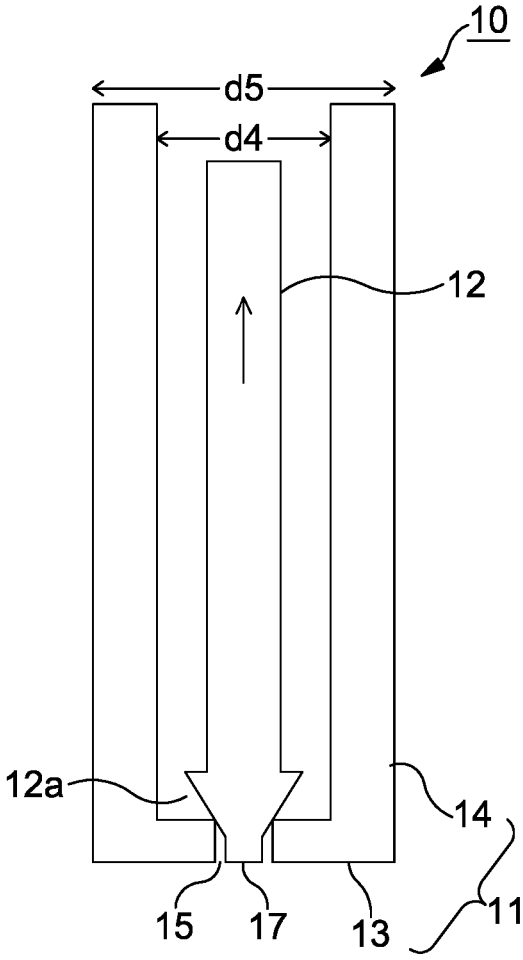
FIGS. 4 and 5 are schematic sectional view of a valve of the present invention in its closed and open states respectively.

The valve stem 12 is provided within the valve body, and is moveable with respect to the valve body. FIG. 4 shows the valve in its closed state, in which the valve stem 12 closes the aperture 15 against the flow of gas or liquid. In the embodiment of FIG. 4 the valve stem 12 has a sealing portion 12*a* that, when the valve is in its closed state, abuts against an inner surface of the end face 13 of the valve body and thereby closes the aperture 15. To open the valve, the stem is moved relative to the valve body in the direction shown by the arrow in FIG. 4, so that the sealing portion 12*a* of the valve stem no longer closes the aperture 15 in the end face of the valve body and gas or liquids can pass through the aperture into the interior of the valve body.

Figure 5:
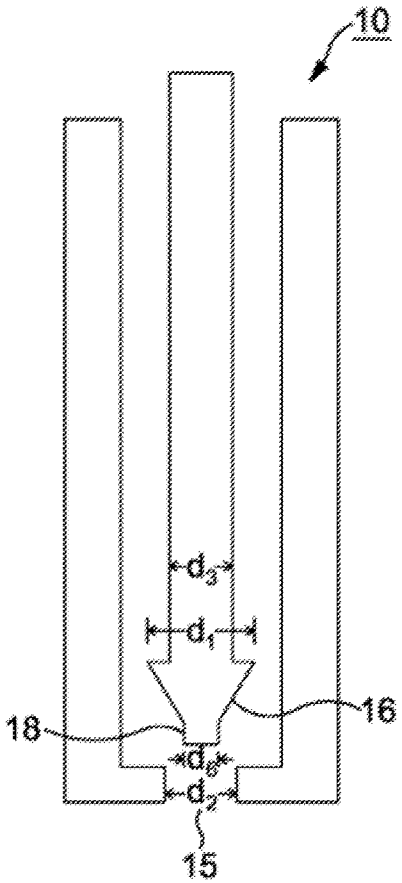

In the embodiment of FIGS. 4 and 5 the wall 14 is cylindrical, and the end face 13 and the aperture 15 in the end face are both circular. As described below this may allow for easy fitting of the valve in place, but the invention is not limited to a cylindrical valve body.

As can be seen from FIGS. 4 and 5, the sealing portion 12*a* of the valve stem 12 is within the valve body in both the closed state of FIG. 4 and the open state of FIG. 5. The sealing portion 12*a* of the valve stem comprises a sealing face 16 for, when the valve is closed, sealing against the end face of the valve body. In the example of FIGS. 4 and 5 the sealing face is a frusto-conical face (that is, is part of the surface of a cone) that, when the valve is closed, seals against the edge of the aperture in the inside surface of the end face of the valve, but the invention is not limited to this form of sealing face.

The use of a frusto-conical sealing surface has the effect that the maximum width $d_1$ of the valve stem (for example the maximum diameter in the case of a valve stem that is rotationally symmetric about its axis) is greater than the width $d_2$ of the aperture 15 (for example the diameter of the aperture in the case of a circular aperture) in the end face of the valve body. This means that the valve stem cannot be removed from the valve body through the aperture. Furthermore the width $d_3$ of the valve stem is preferably also greater than the width $d_2$ of the aperture 15 in the end face of the valve body to maximise the likelihood that, if the valve stem should fracture, the pieces would be retained within the valve body. This is advantageous in certain applications—for example, if the valve stem of the conventional valve shown in FIG. 2 were to fracture, the broken piece of the valve stem would fall into the cylinder and could potentially cause serious damage to the propulsion unit.

In some applications it may be desirable that the valve, when closed, presents a generally smooth end face. In the embodiment of FIG. 4 the valve stem is arranged such that, when the valve is closed, the end face 17 of the valve stem is in the same plane as, or is substantially in the same plane as, the exterior surface of the end face 13 of the valve body. It may also be advantageous if the difference between the diameter of the end face 17 of the valve stem and the diameter of the aperture is kept small, as this also assists with makes the valve, when closed, presenting a generally smooth end face.

Depending on the thickness of the end face of the valve body and on the taper of the frusto-conical portion of the valve stem, it may be desirable to provide the valve stem with a cylindrical portion 18 so that the aperture 15 in the end face is substantially filled.

As noted, in the embodiment of FIG. 4 the exterior of the valve body is generally cylindrical. This facilitates mounting the valve—a hole of the appropriate diameter can be drilled into the component in which the valve is to be mounted. The interior of the valve body may also be cylindrical, and the valve stem may be rotationally symmetric about its axis. However, the invention is in principle not limited to this.

In the embodiment of FIG. 4 the valve stem is positioned substantially along the axis of the valve body and moves along the axis of the valve body, but the invention is again not limited to this.

Figure 6:
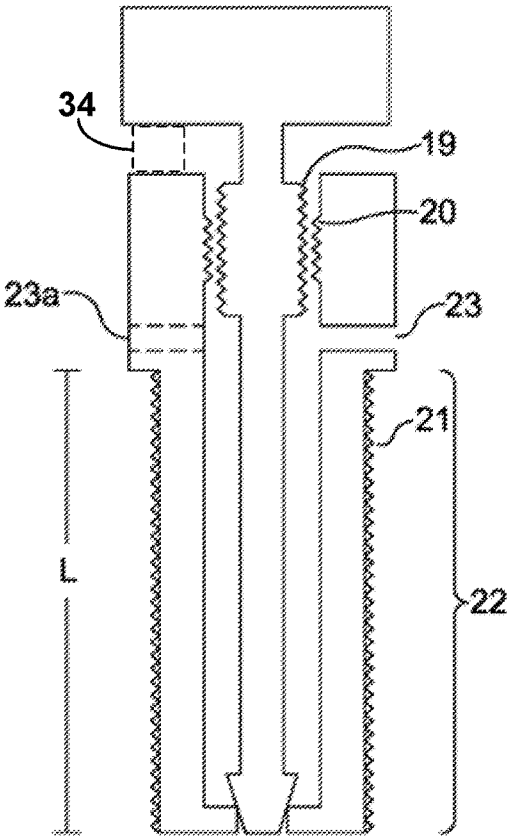
FIG. 6 is a sectional view of another valve of the present invention.

FIGS. 4 and 5 do not show how the valve stem 12 is mounted in the valve body, but FIG. 6 illustrates one possible way in which the valve stem may be mounted in the valve body. In this embodiment the valve stem is provided with an external screw thread 19 that engages with a complementary screw thread 20 on the interior of the valve body. Rotation of the valve stem causes the valve to move along the axis of the valve body, thereby closing or opening the valve.

FIG. 6 also shows a screw thread 21 provided on the exterior of the valve body. This is one convenient way of securing the valve in position—a hole may be drilled in the component in which it is desired to provide the valve, and threaded to provide a screw thread. The valve body may then be screwed into the threaded hole in the component. Preferably the exterior of the valve body is stepped in diameter, with the length L of the narrower portion 22 of the valve body being made equal or approximately equal to the thickness of the component in which the valve is to be mounted.

FIG. 6 also shows an exhaust passage 23 provided in the valve body such that, when the valve is open, gas or liquid entering the valve body through the aperture 15 can leave the valve body through the exhaust passage 23. The invention is not limited to a single exhaust passage, and one or more further exhaust passages 23*a* may be provided as indicated in broken lines in FIG. 6.

Figure 7:
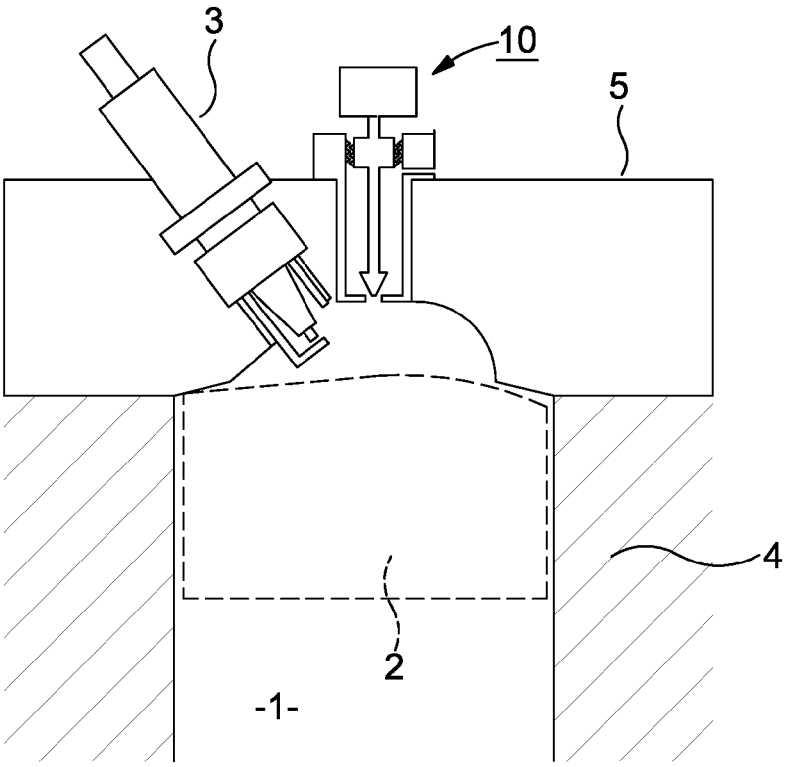
FIG. 7 shows the valve of FIG. 6 mounted in the cylinder head of a marine propulsion unit.

FIG. 7 illustrates a valve 10 of the invention in use as a drain valve in a cylinder 1 of a marine propulsion unit. FIG. 7 corresponds generally to FIG. 2, except that the conventional valve 6 of FIG. 2 is replaced by a valve 10 of the present invention, and description of components that are common to FIG. 2 and FIG. 7 will not be repeated.

In order to explain the use of the valve as shown in FIG. 7, a description of the process of purging water from a marine propulsion unit as described in GB 2 349 420 will be given with reference to FIG. 3.

Figure 3:
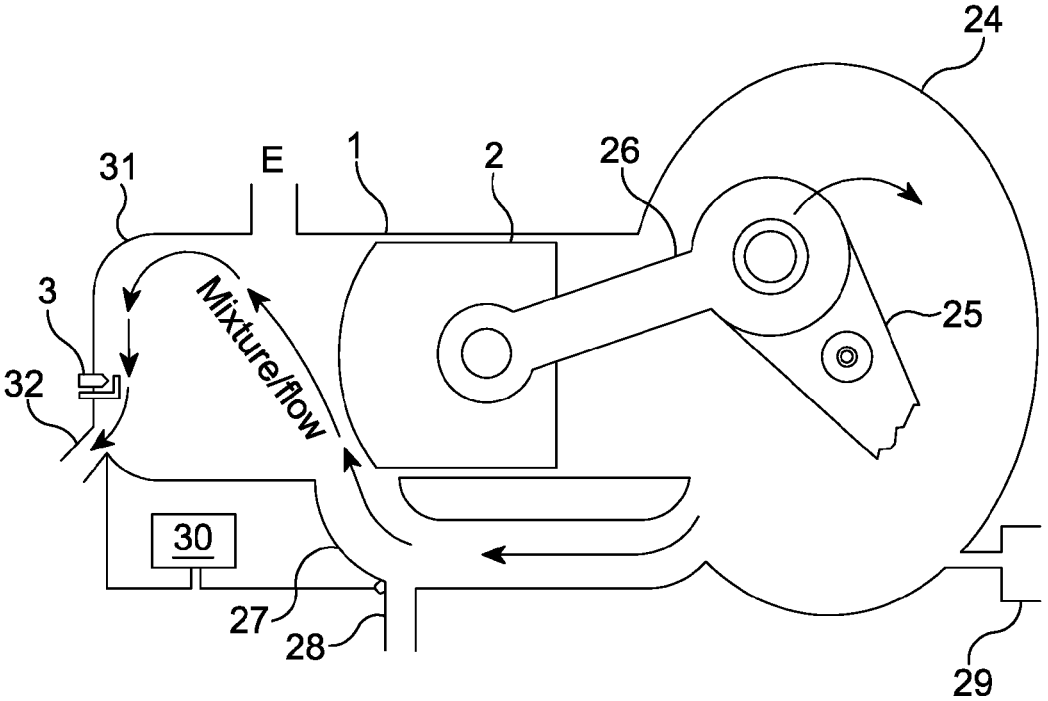
FIG. 3 is a schematic illustration of a marine propulsion unit illustrating the process of purging the unit of water after immersion of the propulsion unit.

The valve 10 of FIG. 7 corresponds to the first valve 32 of FIG. 3. If the marine propulsion unit on which the valve 10 of FIG. 7 is provided should be immersed, water can be drained from the cylinder by opening the valve 10 and reciprocating the cylinder 2 in the manner described above with reference to FIG. 3. Furthermore, the valve 10 of FIG. 7 is positioned near to the spark plug 3 so that, once water has been expelled from the cylinder, continued reciprocation of the piston 2 will cause gases within the top of the cylinder to flow over the spark plug, thereby drying the spark plug.

In the application of FIG. 7, a valve 10 of the present invention provides advantages over the prior valve 6 of FIG. 2. One advantage is that, as described above, the valve stem 12 cannot pass through the aperture 15 in the valve body. Thus, if the valve stem should fracture, the detached portion(s) of the valve stem will be retained in the valve body. In contrast, if the valve stem of the conventional valve 6 of FIG. 2 were to fracture, the detached portion(s) of the valve stem would fall into the combustion chamber and could cause serious damage to the propulsion unit.

Another advantage another benefit of a valve 10 of the present invention is that it provides less resistance to liquid flow from the cylinder through the valve. As can be appreciated from FIG. 2, with the conventional valve 6 it is necessary for water being drained from the cylinder, or for gases being expelled from the cylinder to dry the spark plug, to flow round the head of the valve before leaving the cylinder. When a valve of the present invention is used, however, water or gases can flow into the valve body through the aperture 15 with little resistance—provided that the length L of the reduced diameter portion of the valve body is chosen correctly, the valve may be such that the end face of the valve body is flush or substantially flush with an internal surface the combustion chamber, as shown in FIG. 7. This provides more efficient drainage of water and/or more efficient drying of the spark plug. Furthermore, making the end face of the valve body flush or substantially flush with an internal surface the combustion chamber minimises the effect on the engine of providing the valve, as the valve has little or no effect on gas flow paths in the cylinder in normal operation of the engine when the valve is closed.

One example of a valve according to the invention has the following dimensions:

maximum diameter of valve stem ($d_1$): 5.3 mm
diameter of aperture ($d_2$): 4.0 mm
diameter of valve stem ($d_3$): 4.0 mm
inside diameter of valve body ($d_4$): 6.5 mm
outside diameter of valve body ($d_5$): 12 mm
diameter of end portion 18 of valve stem ($d_6$): 1.5 mm
overall length of valve body: 30 mm It should be understood that the invention is not limited to the preferred embodiments described above, and that many variations are possible. For example, rather than having the valve stem mounted in the valve body using a screw thread as shown in FIG. 5, the valve stem may be mounted for translational movement relative to the valve body. To open the valve, a user would need to pull the valve body to cause it to move relative to the valve body and thereby open the aperture 15.

A valve of the invention may be biased towards one or other the open or closed state, depending on its intended application. For example, in an embodiment in which the valve stem is mounted for translational movement relative to the valve body, the valve stem may be biased towards a position in which it closes the aperture 15, for example by a spring, eg a coil spring, or other bias member.

If desired, the valve may be provided with a locking means to lock the valve in one or both of its open and closed states. Whether the locking means locks the valve in its open state and/or its closed state will depend on the intended application of the valve where a valve is intended for use a cylinder drain valve as shown in FIG. 7, for example, it is more important that the valve can be locked in its closed state than in its open state, since if the valve were to open when the propulsion unit were running normally this would affect the performance of the propulsion unit. In contrast, if the valve were to close inadvertently when the propulsion unit was being drained of water this would be of lesser consequence.

In the case of a valve that is changed from its closed state to its open state by rotation of the valve, as in FIG. 6, a locking means may be provided to prevent rotation of the valve stem relative to the valve body, for example as a catch 34 that can engage with the valve stem and prevent rotation of the valve stem. To open the valve, a user must first undo the catch so that the valve stem is free to rotate.

The invention claimed is:

1. A marine propulsion unit comprising:
a cylinder;
a combustion chamber extending from a first end of the cylinder;
a spark plug disposed within the combustion chamber; and
a piston reciprocably moveable within the cylinder;
wherein the unit further includes a user-operable valve, the valve being selectively openable independent of the position of the piston within the cylinder, the valve being positioned such that, in its open state, movement of the piston causes gas within the propulsion unit to flow over the spark plug and subsequently to flow out of the propulsion unit through the valve;
wherein the valve includes
a valve body having an end face and a wall extending from the end face, an aperture being defined in the end face; and
a valve stem moveable within and with respect to the valve body, the valve stem having a sealing portion located within the valve body in both an open state and a closed state of the valve, wherein, in the closed state of the valve, the sealing portion of the valve stem abuts against an inner surface of the end face and thereby closes the aperture;
wherein a maximum width of the valve stem is greater than the width of the aperture in the end face of the valve; and
wherein in the open state, the sealing portion of the valve stem is spaced apart from the inner surface of the end face of the valve body by a sufficient distance to permit water to drain from the cylinder through the valve.

2. A marine propulsion unit as claimed in claim 1 wherein the sealing portion of the valve stem comprises a sealing face provided on the valve stem, the sealing face abutting against the circumference of the aperture when the valve is in the closed state.

3. A marine propulsion unit as claimed in claim 2 wherein the sealing face is a frusto-conical sealing face.

4. A marine propulsion unit as claimed in claim 1 wherein, when the valve is in the closed state, an end of the valve stem is substantially flush with the outer surface of the end face of the valve body.

5. A marine propulsion unit as claimed in claim 1, wherein, in the closed state of the valve, the valve stem does not project beyond the outer surface of the end face of the valve body.

6. A marine propulsion unit as claimed in claim 2, wherein the valve stem comprises a portion extending beyond the sealing portion, the portion, when the valve is in a closed state, extending into the aperture in the end face.

7. A marine propulsion unit as claimed in claim 1 wherein rotation of the valve stem relative to the valve body causes the valve to change from the closed state to an open state.

8. A marine propulsion unit as claimed in claim 1, wherein the valve is provided within the combustion chamber.

9. A marine propulsion unit as claimed in claim 8, wherein the end face of the valve body is substantially flush with an internal face of a wall of the combustion chamber.

10. A marine propulsion unit as claimed in claim 1, wherein the valve stem includes threads that engage a complimentary thread on the interior of the valve body and that allow for rotation of the valve stem relative to the body and wherein the marine propulsion unit further includes a locking catch for engaging the valve stem to prevent subsequent rotation of the valve stem relative to the valve body, enabling the sealing portion to be locked in either of the open state or the closed state.

* * * * *